US006322196B1

(12) United States Patent
Lim

(10) Patent No.: US 6,322,196 B1
(45) Date of Patent: Nov. 27, 2001

(54) INKJET SERVICE STATION AND METHOD OF USING SAME

(75) Inventor: Eikky Lim, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/471,434

(22) Filed: Dec. 23, 1999

(51) Int. Cl.[7] ..... B41J 4/65
(52) U.S. Cl. ..... 347/35; 347/36
(58) Field of Search ..... 347/35, 36, 29, 347/30; 141/351

(56) References Cited

U.S. PATENT DOCUMENTS

| | | | | |
|---|---|---|---|---|
| 5,500,659 | | 3/1996 | Curran et al | 347/28 |
| 5,504,508 | | 4/1996 | Hashimoto | 347/24 |
| 5,617,124 | * | 4/1997 | Taylor et al. | 347/35 |
| 5,719,603 | | 2/1998 | Nguyen | 347/31 |
| 5,980,018 | * | 11/1999 | Taylor et al. | 347/31 |
| 6,050,671 | * | 4/2000 | Rotering | 347/35 |

FOREIGN PATENT DOCUMENTS 11091138 4/1999 (JP) .

* cited by examiner

*Primary Examiner*—N. Le
*Assistant Examiner*—Shih-Wen Hsieh

(57) ABSTRACT

An inkjet service station includes a spittoon housing having a chopper containing compartment and a residual ink receiving compartment. The chopper containing compartment and the residual ink receiving compartment are separated by a wall having a passageway disposed therein. A lever having an opening formed in it is mounted within the chopper containing compartment for moving pivotally in a forward direction through the passageway and into the residual ink receiving compartment for accumulating spitted residual ink on a top surface thereof during printhead servicing. Upon completion of printhead servicing, the lever moves pivotally backward through the passageway to facilitate the removal of at least a portion of the accumulated spitted residual ink therefrom so that the portion falls into the residual ink receiving compartment.

10 Claims, 2 Drawing Sheets

INKJET SERVICE STATION AND METHOD OF USING SAME

BACKGROUND OF THE INVENTION

The present invention relates generally to inkjet printers and, more particularly, to techniques for preventing ink, expelled from inkjet nozzle plates during servicing at a service station, from forming a stalagmite in the printer spittoon.

Conventional inkjet print engines contain three primary components that are generally organized in series. These components are the platen (including a print zone) the spittoon, in which excess print drops are disposed, and the service station where printhead nozzle wiping occurs.

In a conventional inkjet print engine, there may be one or more ink cartridges, or printheads, mounted side by side on a traversing carriage that moves substantially perpendicular to the path of media, such as paper, which pass through the machine, to be printed upon. With ongoing development and improvements in printer technology, spittoon design and function must be considered. For example, in many cases a spittoon can be one common receptacle for receipt of excess ink drops from multiple printheads. There are, however, cases in which incompatibilities between inks have resulted in a requirement of separate spittoons.

Another consideration in modern inkjet service stations, especially when pigment based inks are used, is the accumulation of spitted residual ink within the spittoon. Such accumulation can occur in a manner in which the ink residue forms a "stalagmite" on the bottom of the spittoon. This accumulation, if not relieved, can have a deleterious effect on print quality as the stalagmite grows to a height whereby it interferes with printhead servicing. Thus, it would be advantageous to have an efficient technique for preventing or substantially reducing stalagmite formation in the spittoon. Desirably, such a technique could be utilized during print operations, without interrupting the operations.

In recognition of the stalagmite problem, some conventional modern inkjet printers have been provided with a mechanical chopper that serves to break up the residue. In some cases, such a chopper is a complicated device, requiring a dedicated motor to drive it. While this approach to the stalagmite problem may have some utility, it complicates inkjet printer design and adds to system cost.

In view of the foregoing, it is apparent that there is a need for a stalagmite removal technique that is effective and efficient in use. Desirably, such a technique would eliminate or substantially reduce stalagmite formation in the spittoon, without any need for a complicated, dedicated motor. Implementation of such technique would result in a more efficient printer having lower product weight and cost.

DISCLOSURE OF THE INVENTION

According to the present invention there is provided an inkjet service station that includes a spittoon housing having a chopper containing compartment and a residual ink receiving compartment. The chopper containing compartment and the residual ink receiving compartment are separated by a wall having a passageway disposed therein. A lever having an opening formed in it is mounted within the chopper containing compartment for moving pivotally in a forward direction through the passageway and into the residual ink receiving compartment for accumulating spitted residual ink on a top surface thereof during printhead servicing. Upon completion of printhead servicing, the lever moves pivotally backward through the passageway to facilitate the removal of at least a portion of the accumulated spitted residual ink therefrom so that the portion falls into the residual ink receiving compartment.

The inkjet service station of the present invention affords several distinct advantages. It is mechanically simple and inexpensive to produce or to replace if necessary. Importantly, the service station does not require a motor to operate it since carriage movement drives the service station alone.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
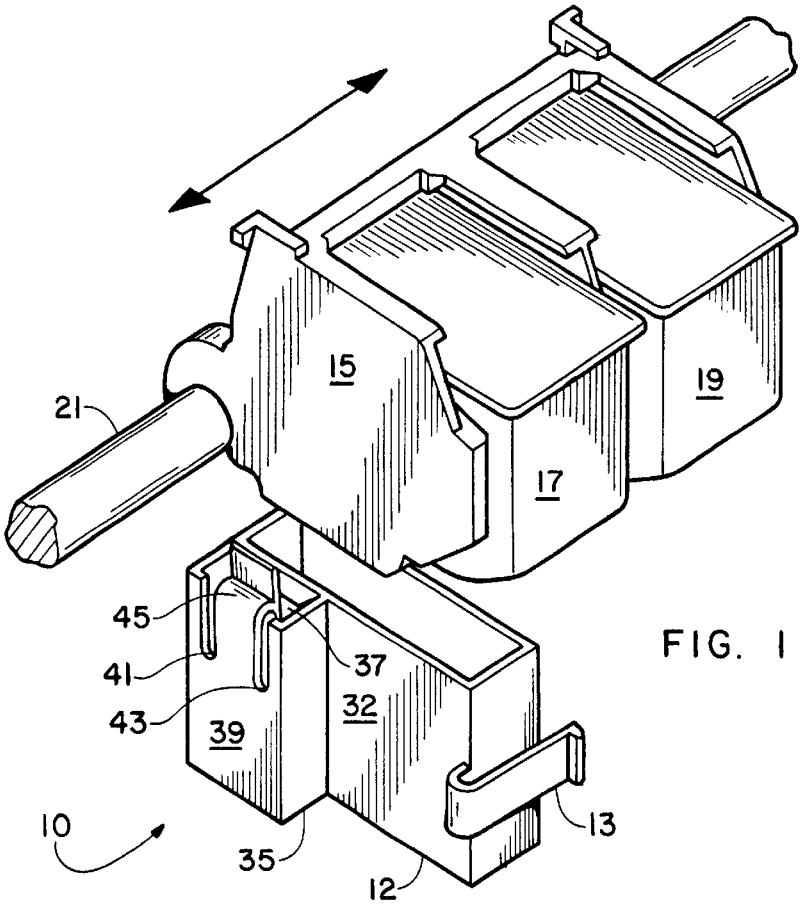
FIG. 1 is a perspective view of a portion of an inkjet printer, showing a carriage carrying printheads, in separated relationship with an inkjet service station that is constructed according to the present invention.

As set forth above, especially with the use of pigmented inks, ejected residue inks tend to accumulate in the form of a stalagmite, with accretions over time causing the stalagmite to grow to an unacceptable height. In this regard, unarrested stalagmite growth within the spittoon can become so substantial that the stalagmite can occlude printhead nozzle plates, thereby substantially diminishing print quality. The service station of the present invention substantially reduces the formation of a stalagmite within the spittoon by regularly truncating a growing stalagmite, during print operations.

Referring now to the drawings, there is shown an inkjet service station 10 that is constructed according to the present invention. The service station 10 includes a generally box-like spittoon housing 12 having a chopper containing compartment 35 and a residual ink receiving compartment 32. A wall 31, having an opening or passageway 37 therein formed, separates the chopper containing compartment 35 and the residual ink receiving compartment 32.

It may be helpful, before discussing the service station 10 in further detail, to set forth the environment in which the service station 10 is utilized. As shown in FIG. 1, a clip 13 serves to attach the service station 10 to a printer housing (not shown). During print operations, a carriage 15, having inkjet printheads 17 and 19 affixed thereto, travels along a rod 21. The direction of travel is indicated by a double headed arrow and, for reasons of convenient description, travel of the carriage 15 to the left (as one views FIG. 1) may be described as moving laterally while travel in an opposite direction may be described as moving medially.

The printheads 17 and 19 each include a nozzle plate 23 and 25 respectively, through which ink droplets are ejected onto media (not shown) during the printing operation. It is known by those skilled in the art that printhead servicing occurs periodically during a printing operation and that such servicing includes a stop at a residual ink receiving compartment, such as the residual ink receiving compartment 32, into which excess ink is spit from the printheads 17 and 19.

Figure 2:
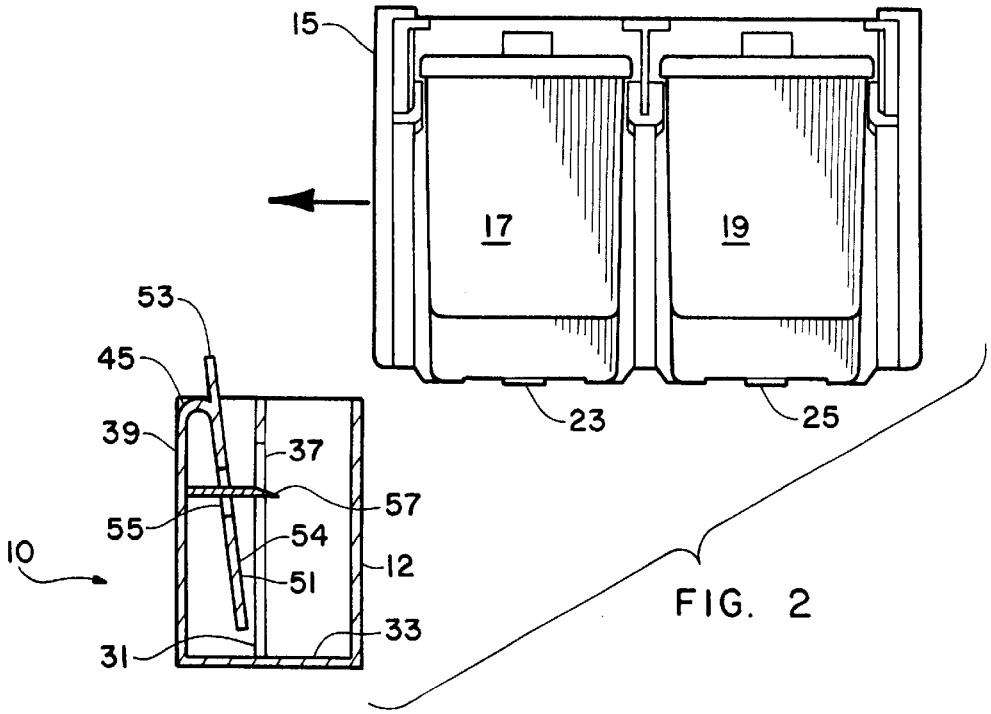
FIG. 2 is a schematic view showing a carriage carrying printheads in separated relationship with an inkjet service station that is constructed according to the present invention.

Considering the spittoon housing 12 in greater detail, with reference to FIGS. 1 and 2, the spittoon housing 12 is generally box-like in shape, having an interior wall 31 and a bottom 33. The interior wall 31 separates the residual ink receiving compartment 32 from the chopper containing compartment 35. The chopper containing compartment 35 includes an exterior wall 39. The wall 39 may be constructed of a variety of materials with plastic being preferred. Slots 41 and 43, formed in the exterior wall 39, help to define a resilient central portion or hinge 45. A lever 51 is integrally connected to the hinge 45 in such a manner that the lever 51 is pivotally movable from a first, or at rest position, within the chopper containing compartment 35, to a second position whereby the lever 51 extends into the residual ink receiving compartment 32. In this manner, the lever 51 is movable in a forward direction, through the opening or passageway 37 in the wall 31, whereby the lever 51 is positioned for accumulating spitted ink on the top surface thereof.

While the lever 51 is one integral piece, it may be conveniently regarded as having a tab 53 at an upper end and a residual ink receiving portion at the end opposite the tab 53. An opening 55 is formed in the body of the lever 51 at a location between the tab 53 and the residual ink receiving portion 54.

Figure 3:
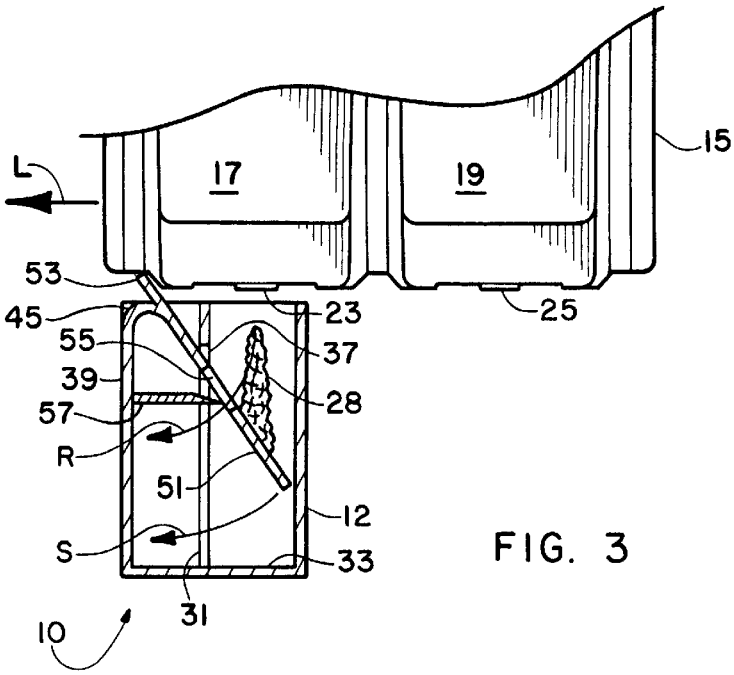
FIG. 3 is a schematic view showing the relationship between an inkjet printhead and the service station of the present invention, during printhead servicing.

With reference to FIG. 2, it will be noted that during a printing operation, as the carriage 15 moves laterally in the direction shown by the arrow L, the printhead 17 contacts the tab 53. As shown in FIG. 3, the printhead 17 contacts the tab 53, urging the tab 53 laterally, thereby causing the lever 51 to rotate about the hinge 45. In thus moving from a first position to a second position, the lever 51 is positioned in the residual ink receiving compartment 32 for receipt, on its top surface, of ink spitted from the printhead 17. It will be recognized that by virtue of the resilience of the hinge 45, the lever 51 tends to rotate in the direction shown by the arrows R and S. However, the lever 51 is constrained from so moving by the force applied to the tab 53 by the printhead 17. During the servicing operation, spitted ink forms a stalagmite 28 on the top surface of the lever 51. After completion of servicing of the printhead 17, the carriage 15 moves laterally for similar servicing of the printhead 19. Of course, as the carriage 15 continues in its lateral travel, the tab 53 is held in place, thereby continuing to hold the lever 51 within the residual ink receiving compartment 32, until servicing of the printhead 19 is accomplished.

Figure 4:
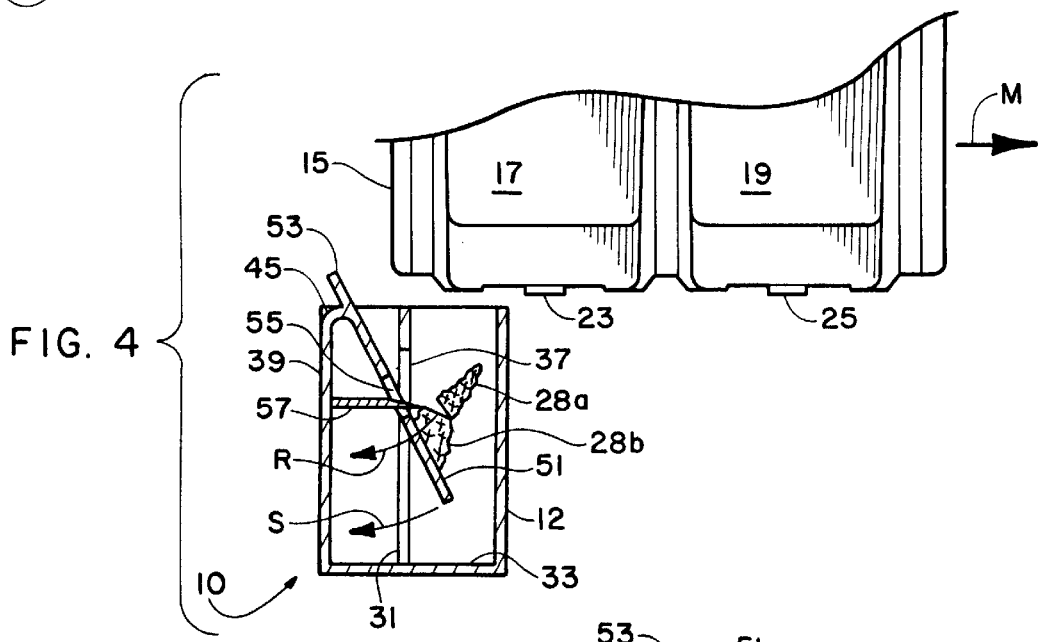
FIG. 4 is a schematic view showing the relationship between the inkjet printhead and the service station of the present invention, after completion of printhead servicing.
Figure 5:
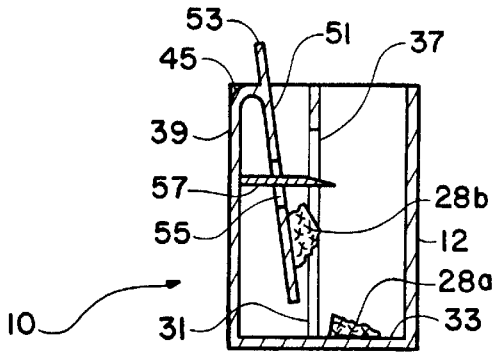
FIG. 5 is a schematic view of the inkjet service station of the present invention.

Upon completion of servicing of the printheads 17 and 19, the carriage 15 moves medially in the direction shown by the arrow M (FIG. 4). As the carriage 15 moves away from the tab 53, the force urging lateral rotation of the tab 53 is removed and the lever 51 rotates about the hinge 45 and back toward the at rest position, as shown by the arrows R and S. As the lever 51 returns to the at rest position, a sharpened chopper blade 57, mounted at a proximate end thereof in the chopper containing compartment 35, extends through the lever opening 55. In this manner, as shown in FIG. 4, the chopper blade 57 truncates the stalagmite 28 by cutting it into two portions 28*a* and 28*b*. The truncated portion 28*a* then falls toward the spittoon bottom 33 where it is unlikely to interfere with printer operations.

From the foregoing it will be appreciated that the inkjet service station provided by the invention provides an efficient and low cost solution to the stalagmite formation problem. The service station is mechanically simple, easy to assemble and relatively easy to remove and replace if such becomes necessary.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An inkjet service station, comprising:

a spittoon housing having a chopper containing compartment and a residual ink receiving compartment, said chopper containing compartment and said residual ink receiving compartment being separated by a wall having a passageway disposed therein; and a lever having an opening and mounted within said chopper containing compartment for moving pivotally in a forward direction through said passageway for accumulating spitted residual ink on a top surface thereof when partially disposed within said residual ink receiving compartment and for moving pivotally backward through said passageway to facilitate the removal of at least a portion of the accumulated spitted residual ink therefrom so that said portion falls into said residual ink receiving compartment.

2. The inkjet service station according to claim 1 further comprising:

a chopper blade mounted at a proximate end thereof in said chopper containing compartment and extending through said opening in said lever so that a distal end of said chopper blade is disposed within said residual ink receiving compartment for slicing the accumulated spitted residual ink disposed on the top surface of said lever to prevent any substantial stalagmite formation thereon.

3. The inkjet service station according to claim 1, wherein said chopper containing compartment includes an exterior wall and a hinge integrally connected to said exterior wall and to said lever.

4. The inkjet service station according to claim 3, wherein said lever includes a residual ink receiving portion and said lever opening is formed between said portion and said hinge.

5. The inkjet service station according to claim 3, wherein a portion of said lever extends above said exterior wall.

6. The inkjet service station according to claim 3, wherein said hinge is partially defined by a pair of parallel slots formed in said exterior wall.

7. A method of helping to prevent stalagmite formations in an inkjet service station including a spittoon housing having a chopper containing compartment and a residual ink receiving compartment, the chopper containing compartment being separated by a wall having a passageway disposed therein, comprising:

moving a lever pivotally mounted within said chopper containing compartment in a forward direction through said passageway for accumulating spitted residual ink on a top surface thereof when partially disposed within said residual ink receiving compartment; and moving said lever pivotally backward through said passageway to facilitate the removal of at least a portion of the accumulated spitted residual ink therefrom so that said portion falls into said residual ink receiving compartment.

8. The method according to claim 7, wherein said step of moving said lever pivotally forward through a passageway includes passing a chopper blade mounted at a proximate end thereof in the chopper containing compartment through an opening in the lever so that a distal end of said chopper blade is disposed within the residual ink receiving compartment.

9. The method according to claim 7, wherein said step of moving said lever pivotally backward through said passageway includes slicing with the distal end of said chopper blade the accumulated spitted residual ink disposed on the top surface of said lever to prevent any substantial stalagmite formation thereon.

10. An assembly for preventing stalagmite formation in an inkjet printer spittoon wherein the inkjet printer is of the type having a printhead, including a nozzle plate, attached to a carriage for transverse movement along an axis, the assembly comprising:

a spittoon including a side wall having an opening therein formed;

an housing fixed to said spittoon side wall, said housing including a side wall;

a lever having an opening and pivotally attached to said housing side wall, for movement through said spittoon side wall opening between a first position and a second position, said lever including a portion for receiving ink ejected from a printhead, when said lever is in said first position;

a tab integrally connected to said lever, at an upper end thereof, wherein said tab engages said printhead nozzle plate during transverse movement of said carriage, whereby said nozzle moves said tab from said first position to said second position;

a chopper blade, mounted on the inside surface of said spittoon side wall, wherein said blade extends through said lever opening to cut away a portion of the received ink, as said lever moves to said second position, thereby preventing stalagmite formation in said spittoon.

* * * * *